US008691024B2

(12) United States Patent
Barniak, Jr.

(10) Patent No.: US 8,691,024 B2
(45) Date of Patent: Apr. 8, 2014

(54) COMPLETE SANITARY SYSTEM FOR THE TOILET; FLOOR BASE COLLECTION AND DRAIN STRUCTURE, MECHANICAL APPARATUSES AND PLUMBING METHOD

(76) Inventor: Thomas John Barniak, Jr., Medina, OH (US)

( * ) Notice: Subject to any disclaimer, the term of this patent is extended or adjusted under 35 U.S.C. 154(b) by 387 days.

(21) Appl. No.: 12/925,903

(22) Filed: Nov. 2, 2010

(65) Prior Publication Data

US 2011/0120504 A1 May 26, 2011

Related U.S. Application Data

(60) Provisional application No. 61/281,776, filed on Nov. 23, 2009.

(51) Int. Cl.
*B08B 3/00* (2006.01)
*B08B 7/00* (2006.01)
*E03C 1/12* (2006.01)

(52) U.S. Cl.
USPC ..... 134/42; 134/10; 134/34; 4/662; 4/252.1; 4/251.1

(58) Field of Classification Search
USPC ..... 4/662, 252.1, 252.4, 251.1; 134/10, 34, 134/42
See application file for complete search history.

(56) References Cited

U.S. PATENT DOCUMENTS 3,183,525 A * 5/1965 O'Brien et al. ..... 4/665
3,646,617 A * 3/1972 Heald ..... 4/300.2
3,869,732 A * 3/1975 Garvey et al. ..... 4/662
4,165,545 A 8/1979 Stoltzfus
4,718,131 A * 1/1988 Kitamura et al. ..... 4/663
5,065,462 A * 11/1991 Romano ..... 4/604
5,503,633 A * 4/1996 Saunders et al. ..... 604/332
6,085,361 A 7/2000 Whitaker
6,174,581 B1 1/2001 Barker
6,789,552 B1 * 9/2004 Robinson et al. ..... 134/22.18
7,222,632 B2 * 5/2007 Gagosz ..... 134/166 R
7,458,109 B1 12/2008 Kreisel
7,621,002 B1 * 11/2009 Helmstetter et al. ..... 4/252.1
2005/0283889 A1 * 12/2005 Flushing ..... 4/252.1
2006/0096016 A1 * 5/2006 Krowl ..... 4/341
2008/0134424 A1 * 6/2008 Riccobon ..... 4/420.5
2009/0211008 A1 * 8/2009 Fucito ..... 4/345
2011/0168281 A1 * 7/2011 Garza Laguera Garza ... 137/560

* cited by examiner

*Primary Examiner* — Alexander Markoff

(57) ABSTRACT

A complete sanitary system for any toilet site area which allows for the utilization of pressurized domestic running water transferred through a hose connected to a water valve diverting structure further connected to the main toilet domestic water feed line to that particular toilet's water closet. A floor structure with the aforementioned toilet mounted to its top surface side provides the structure to collect, retain and drain the spent waste water from the hose after the water has been used to cleanse the toilet site area. An alternative drainage location in the retention basin of the floor structure with coinciding plumbing piping method allows for a possible solid waste contamination scenario by an overflow toilet or otherwise to be effectively transferred directly into the main sewer pipe. The use of pressurized domestic running water in an effective manner to clean a toilet site without flooding the general bathroom floor area with water and therein providing a structure to collect and drain the spent waste water after cleansing usage provides for a totally novel and prudent sanitary cleansing approach unto the sanitation requirement of the bathroom toilet area.

4 Claims, 4 Drawing Sheets

COMPLETE SANITARY SYSTEM FOR THE TOILET; FLOOR BASE COLLECTION AND DRAIN STRUCTURE, MECHANICAL APPARATUSES AND PLUMBING METHOD

CROSS-REFERENCE TO RELATED APPLICATIONS

This application claims the benefit of provisional patent application Ser. No. 61/281,776, filed 2009 Nov. 23 by the present inventor, which is incorporated herein.

BACKGROUND OF THE INVENTION

1. Field of Invention

The present invention relates to the methodology of cleaning and sanitizing the toilet fixture and its immediate floor surface area common to all residential households, commercial establishments such as restaurants, hotels, office buildings and the like, multi-family structures such as apartments and condominiums, institutional structures such as hospitals, elderly nursing homes, prisons and any other type of group care facilities and industrial types of toilet areas incorporating individual stalls or enclosures. All of the toilet areas in the aforementioned types of facilities must be cleaned and sanitized periodically for general sanitation purposes. In the case of institutional care facilities, even more periodically often so as to prevent a potential germ and disease-spreading scenario developing and infecting the facility's inhabitants residing in a confined close-quarter type of environment. In the current state of methodology of cleaning and sanitizing a toilet area, a collection pan of water in conjunction with dispersal spray cleaning and/or deodorizing agents is remotely carried by hand to the designated area and applied accordingly, usually with cleaning cloths, sponge or paper products. Contaminates such as blood, vomit, urine or urine spray and/or feces must be hand-cleared and cleaned from the toilet surface, interior and exterior bowl and tank and the immediate floor adjacent therein. The now dirty contaminated collection pan water used for cleaning must be disposed of properly also.

2. Description of the Related Art

After a thorough search of prior art related patents and existing plumbing related products in the current marketplace, except for toilet base structures that are designed to elevate a toilet bowl height from the floor its fastened to, the present inventor has been unable to find any pertinent prior art structures in conjunction with a mechanical apparatus that accomplishes the feat that the present invention provides for, therefore the present inventor believes that the total present invention disclosed herein is novel and unanticipated.

SUMMARY OF THE INVENTION

The present invention can best be described as a total and complete sanitary system for any toilet area consisting of a toilet base floor structure capable of liquid fluid collection and drainage means in conjunction with a method of drawing low volume pressurized domestic water from the toilet domestic water feed line that projects from either the floor or horizontal wall, usually in very close proximity—almost always directly underneath the toilet water closet or tank, for cleaning and cleansing the exterior of the toilet, interior of bowl and the aforementioned floor structure. Important novel attributes of the floor structure are as follows and are not in any order of importance: floor structure front end at bowl to be round or elongated to match host toilet, low profile rounded edge, especially at front end at bowl, so as not to stub a bare toe on and to be as inconspicuous as possible; floor structure widens at its rear or back side under the water closet of its host toilet to gain floor area for drainage; widened or rear floor structure is at a lower elevation or recessed level in relation to its front end side—drops or slopes in elevation at the rear point of toilet base—creating a two level fluid collection floor structure; total floor structure of a composition such as acrylic, fiberglass acrylic, cultured marble or hard surface type suitable for its rigidity strength but also providing a material suitable for drilling or cutting a hole for custom on-site plumbing drain locations in the recessed floor rear widened area under the water closet; total floor structure can be recessed in a wood floor construction scenario to equal the height of the finished floor of the bathroom for even more unobtrusiveness, if desired; the closet or toilet flange hole can be either factory drilled or can be drilled on-site by the plumber; the total floor structure can be fastened to a wood or concrete slab floor by various methods, including gluing and mortaring into place with construction adhesive and/or ceramic tile adhesive; the total floor structure has capability to capture and collect for drainage all possible liquid fluid and solid matter in the case of a toilet overflow, water closet or domestic water feed line to closet type of leak; urine, blood or human vomit contaminants and also condensation moisture dripping from the water closet during certain atmospheric conditions.

The mechanical apparatus that works in conjunction with the toilet floor collection structure is a valve structure containing a channel or raced interior for water flow; the valve having a lower exterior threaded portion capable of mating into a threaded receiving offset housing structure contained on the domestic water closet feed line; the lowest portion of the valve mates and seats in a tapered section containing a hole therein for water flow at the bottom or beginning of the offset housing structure when fully threaded into the offset structure; the exterior surface of the valve protruding from the offset structure when fully threadably engaged contains a geometric structure such as a hex configuration for engagement with a wrench or handle: the extreme topmost exterior surface of the valve protruding when threadably engaged or disengaged in the offset housing structure, as the case may be, is formed in a series of concentric tapered ridges capable of capturing and holding in a friction-like manner, a lightweight hose such as a material composition of vinyl or polyvinyl, for as an example. When the valve is fully threaded into and seated in the tapered hole of the offset structure, water does not and cannot flow through the channel or raceway contained in the interior of the valve. When the tapered tip of the valve is unseated from the receiving tapered section containing the water flow hole in the offset housing structure by the process of turning the valve with a wrench or handle, water therein flows through the channeled interior of the valve and into the gripped aforementioned hose structure thereby providing a controlled low pressurization-low volume domestic water source for cleansing, flushing and rinsing the exterior and/or interior of the toilet—whatever the situation dictates for a cleaning solution. The aforementioned floor structure, strategically mounted to the toilet base and the floor itself, captures the cleansing water, collects and disposes of it through the drains in the rear collection area of the floor structure, thereby providing a totally novel sanitary system for the toilet area in any type of dwelling or building. A complete understanding of the present invention and its radical transformation of standard procedures to clean and sanitize a toilet area will be very clear and apparent once one views the accompanying drawing figures and their descriptions therein.

DRAWINGS

FIG. 1 is an overall perspective view of the present invention total sanitary system showing its external visible components installed at a typical toilet area site. The components shown are the floor base collection and drain structure, the offset water line fitting containing the water flow valve with a handle fitted unto the hex nut configuration exterior of the valve, a water flow line or hose connected onto the outlet flow end of the valve, an example of the water hose with water flowing through and out the hose outlet end for a typical cleansing use scenario and the two floor drains installed in the recessed rear drainage area of the floor structure.

FIG. 2 is a perspective view of the toilet floor base collection and drain structure component showing the rear recessed floor area containing the two external floor drains, one with a grid and the other with a threaded nut installed; also shows the outward flaring of the rear recessed area and a formed backsplash structure. A typical closet or toilet flange is also shown in place on the top surface of the floor structure where the toilet main waste pipe would be approximately located.

Figure 3:
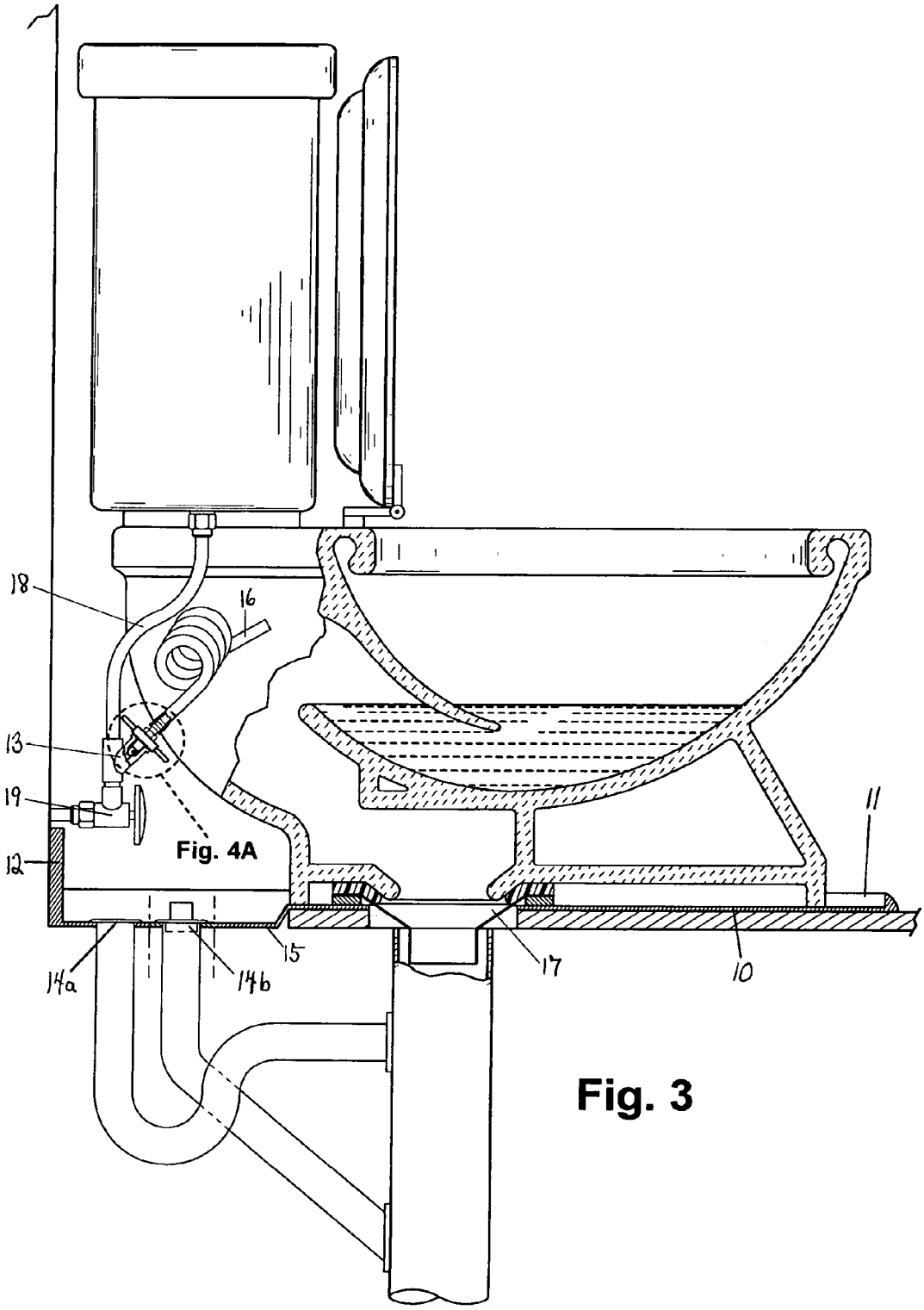
FIG. 3 is a section view of a floor base collection and drain structure installed onto a composite wood floor under a toilet showing all the sanitary system components and a typical sewer main connection under the floor structure for the two types of floor drainage means to be used in the rear recessed drainage area.
Figure 5:
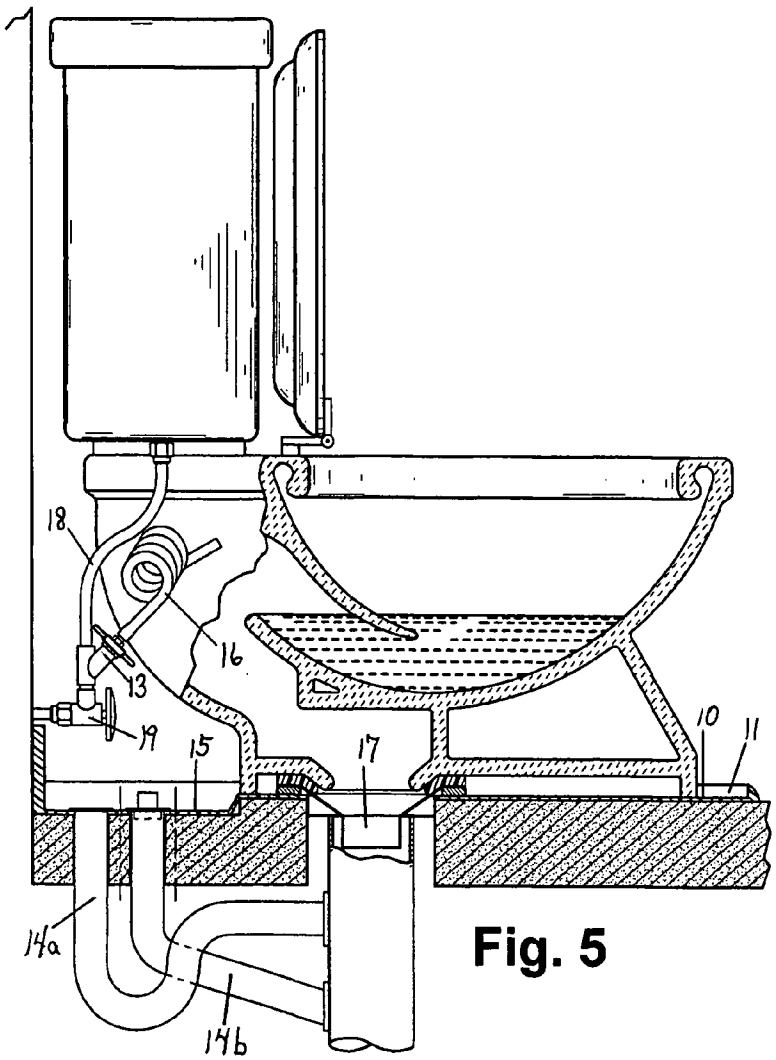

FIG. 5 is a section view of the floor base collection and drain structure of FIG. 3 installed on a concrete floor or slab under a toilet showing a formed recession area in the rear surface of the concrete slab at the rear of the toilet at the wall to accommodate the coinciding recessed portion of the floor structure at its drainage area; illustrates installation technique in a new construction type of scenario.

Figure 6:
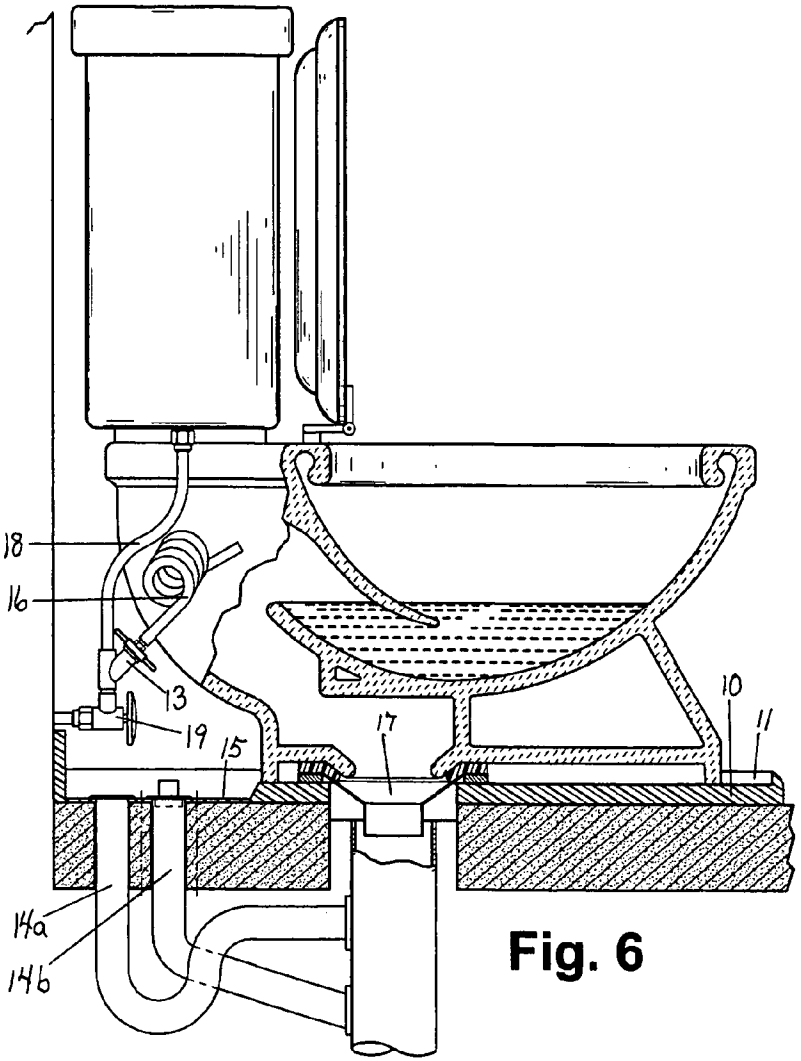

FIG. 6 is a section view of a floor base collection and drain structure installed on an existing concrete floor or slab without the formed recession area shown in FIG. 5 showing the drainage capability of the planar flat-bottom type floor structure embodiment; illustrates 'old construction' scenario type of installation technique.

DRAWINGS

Reference Numerals

| | | | |
|---|---|---|---|
| 10 | floor base structure front section at toilet bowl | 11 | raised lip portion |
| 12 | backsplash portion at rear wall | | |
| 13 | offset valve structure body containing water flow valve with handle grip attached | | |
| 14a | floor drain; p-trapped under floor-with lay-in grid at surface | | |
| 14b | floor drain; untrapped under floor-with threaded nut at surface | | |
| 15 | recessed rear drainage portion of floor structure at drain area | 16 | water hose |
| 17 | toilet or closet floor flange | 18 | domestic water feed line to toilet water closet |
| 19 | typical water line valve-angled or straight, angled shown (water line feeds from rear wall) | | |
| 20 | hollow interior type water flow valve | 21 | ribbed gripping portion for hose attachment |
| 22 | hex shaped portion of flow valve | 23 | tapered bottom tip portion of flow valve |
| 24 | tapered area portion, interior of offset valve structure, mates to tapered portion on flow valve | | |
| 25 | threaded portion of flow valve | 26 | interior threaded walls of offset valve structure |
| 27 | handle or gripping type structure-slidable | | |
| 28 | water introduction hole to interior of hollow flow valve | | |

DETAILED DESCRIPTION AND OPERATION OF DRAWING FIGURES

Figure 1:
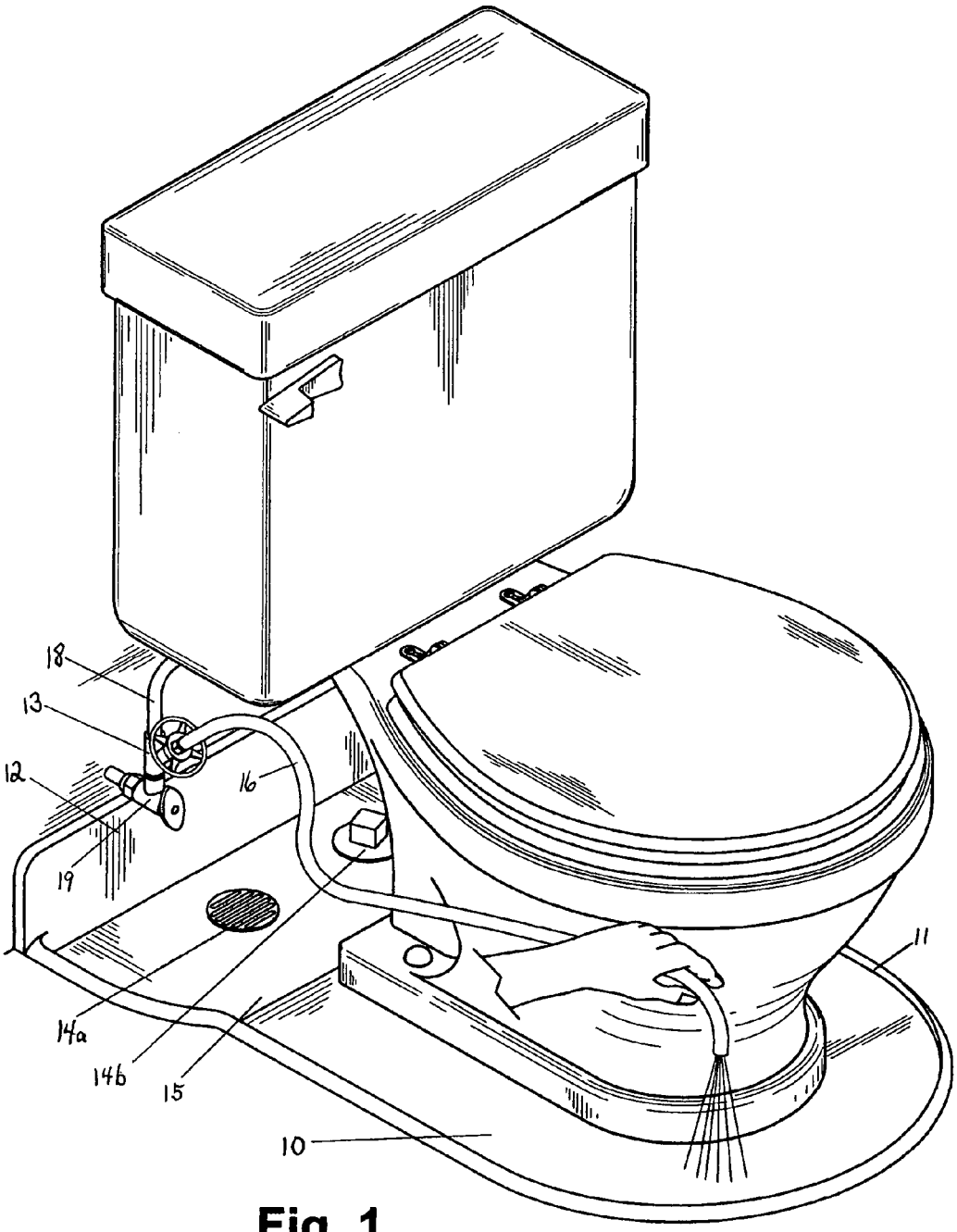

FIG. 1 illustrates in a perspective view the total sanitary system components in use in a typical cleaning and cleansing operation of the exterior bowl area of a toilet. Cleansing water drawn from the domestic water feed line 18 through the offset valve structure body 13 containing flow valve with handle 13 and further through the handheld water hose 16 and onto the exterior of the toilet shows how the floor base front section 10 defined by the raised lip edge 11 collects the runoff cleansing water and therein by gravitational forces, the runoff water flows to the recessed rear drainage area 15 where the water is therein drained through the floor drain 14*a* to the main sewer line (not shown).

Figure 2:
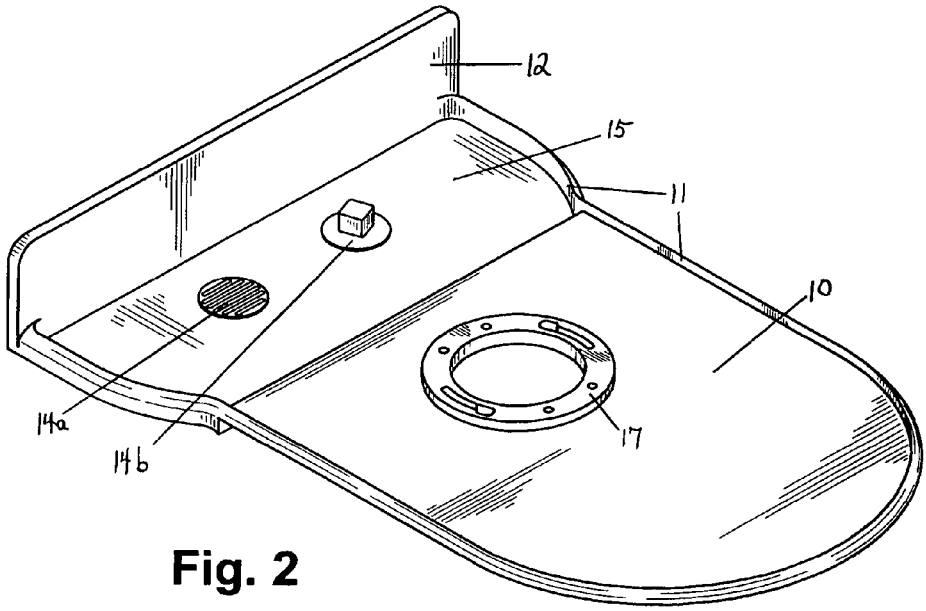

FIG. 2 is of a perspective view of the total floor base structure showing in clear detail how the front section 10 integrates to the recessed rear drainage portion 15 containing two types of drainage means, 14*a* and 14*b*. A typical toilet floor flange 17 is shown on the top exterior surface of the front section 10 as an example of an installation technique for that particular plumbing fitting needed to mount the toilet. This drawing figure also shows how a toilet floor flange 17 would appear if the said floor flange 17 were to be integrated or directly molded into the front floor section 10. Since the total floor structure is designed to be molded or stamped from a multitude of approved composites such as fiberglass acrylic or any number of hard surface type of composites, and the fact that installed floor flanges are generally an industry standard dimension taken laterally from the surface of the rear wall behind the toilet, this manufacturing integration option for the aforementioned toilet floor flange 17 is disclosed by the present inventor and possibly accomplished by the inventor's manufacturer. Note also the integrated rear backsplash 12 and the relation of elevation difference at the integration point of the front section 10 to the recessed rear drainage portion 15 at their abutting bottom sides.

FIG. 3 shows good detail in a sectional view the total floor base collection and drain structure installed on a wood composite floor type. Note how the recessed rear drainage portion 15 is cut into the wood floor—or more exactly stating how the composite sheeting of the wood floor can be cut out and removed so as to accommodate the elevation drop of the rear drainage portion 15. It would even be possible to shave off a top surface dimension of a wood floor joist if it proved to be an impedance (not shown) for a further flush fitting to the composite floor. The section view also shows good detail of the offset valve structure housing with flow valve 13 in a circled plan view. Note how the valve structure body or housing is integrated to the domestic water line 18 at a point after the water valve 19, therein assuring that the valve 19 governs the domestic line 18 as the valve 19 is designed to accomplish in any typical toilet installation scenario—means to isolate or shut off water pressure to a toilet water closet. The present inventor discloses that it would be possible to integrate the offset valve structure body portion 13 (flow valve is threadably independent—explained in next drawing figure) as most domestic water feed lines such as numeral 18 are of a type usually of a plastic composite thereby prompting of the present invention offset valve body or housing containing the flow valve to be integrated into the manufacturing process of the typical toilet water line 18 or more exactly stating; instead of a plumbing fitting—how water valves are customarily fitted to a water line, the present inventor proposes that the inventor's simplified version of an offset flow valve structure body can simply be molded into a typical toilet water feed line—no fitting needed. Of course, the offset structure can be a fitting also. FIG. 3 also shows good detail of the novel plumbing method conceived by the present inventor for total sanitation scenarios that are possible for a toilet area. Drain with floor grid 14*a* is plumbed underneath the composite floor (joist space) with a typical p-trap that holds water for cessation of sewer smells and vapor at the trap point—additional water, such as cleansing water collected, simply flows through the p-trap. Drain 14*b* is plumbed under the floor minus the p-trap. Both drains connect by fittings to the main sewer line—shown as vertical in FIG. 3 (can be horizontal with pitch also, not shown). Drain 14*b* is designed by the present inventor to be a stop-gap type of drainage option in the case of a toilet overflow with waste or human vomit type of episode, to state as examples, wherein a p-trapped waste pipe would be inefficient in disposing of the stated solid matter, as solids don't transfer through a plumbing trap. Drain 14*b* is designed as a typical threaded floor drain with a threadable solid cap with an external nut (usually square for wrench grip). For flushing of solid matter down drain 14*b* with water from the hose 16 will simply be a matter of removing the solid cap with threaded nut and replacing in a threadable manner when finished with the flushing water task. Two inch sized waste pipe should be sufficient for both drainage purposes, but the present inventor does not hold to that fact as conventional plumbing codes will dictate and prevail. Also, the present inventor will state that drain 14*a* should also contain some interior threads at its floor opening (lay-in grid removed) whereas the threaded nut solid cap removed from drain 14*b* will simply thread into drain 14*a* temporarily until the flushing of solid matter down drain 14*b* is completed. This stated proposal will only work if the drains are of identical sized openings at the recessed floor 15 and are not integral to the present invention, but rather disclose a smart engineering possibility for manufacturing.

Figure 4A:
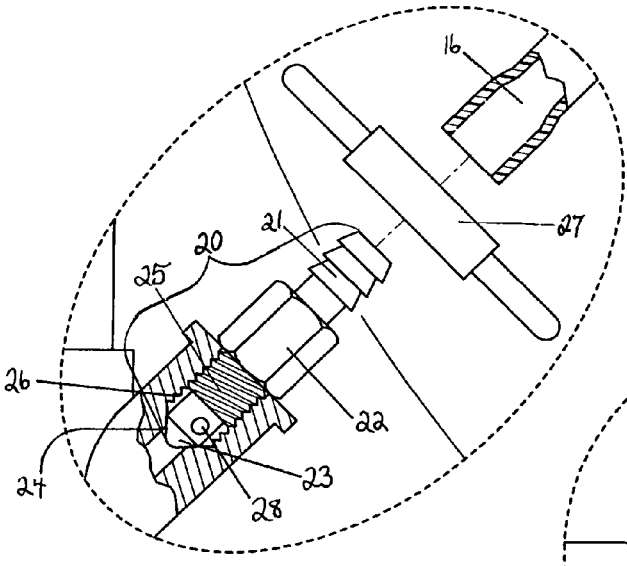
FIG. 4A is a segmented perspective view of the plan view shown in the section view of FIG. 3 showing the threaded hollow or channeled water flow valve in a closed or non-flow seated position in the offset water line fitting; also showing the handle and hose unattached from the water flow valve.
Figure 4B:
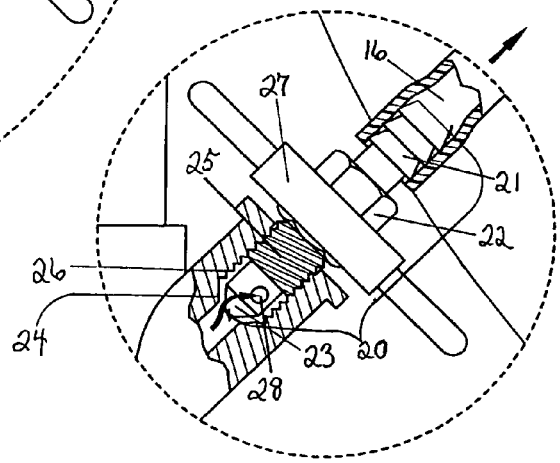
FIG. 4B is a close-in of the plan view shown in the section view of FIG. 3 showing the threaded hollow or channeled water flow valve in an open or flow position in the offset water line fitting with the handle and hose attached to water flow valve. Note the arrows pointing in the direction of water flow in this open position.

FIG. 4A is a close-in sectional of the circled plan view in FIG. 3 showing the hollow interior type water flow valve 20 in a closed or non-flow position in the offset valve structure body with the slidable handle grip 27 and water hose 16 unattached. The hollow or channeled interior of the flow valve 20 starts at the water introduction hole 28 and water exits at the exterior ribbed portion 21. The flow valve 20 is in a non-flow position because the tapered tip 23 is mated to its corresponding tapered area portion in the offset valve structure 24, therein preventing water from entering the introduction hole 28. The flow valve 20 contains a threaded section 25 on its lower exterior above the water hole 28 therein that mates to an interior threaded section 26, thereby holding the flow valve 20 in a threadable fashion. When the handle 27 is slid onto the hex portion 22 as shown in FIG. 4B and the handle 27 turned slightly in a predetermined direction, the tapered tip 23 separates from tapered area or seat 24 in the offset valve structure, allowing for pressurized water to enter water hole 28 and exit the flow valve 20 at the exterior ribs 21 and into the attached hose 16. For clarification purposes, the offset structure body containing the flow valve 20 is an angled body structure with a bored and threaded interior with a tapered seat engagement area at the bottom of the threaded bore. The preferred embodiment offset or doglegged structure body can be molded or formed—a 45 degree angle or thereabouts is sufficient, interiorly bored and threaded with a tapered seating area in the manufacturing process of the domestic water line itself but the offset structure can also be a plumbing type fitting also. The hollow flow valve 20 is designed as a low volume type of water transfer valve as limited water amounts and pressurization is only needed for general cleaning and cleansing in a limited collection area defined by the front of the floor base collection and drain structure. The size of the water introduction hole 28 will have bearing on the volume of water desired to transfer through the flow valve 20. The flow valve 20 is capable of totally being unthreaded and separated from the offset structure body for replacement (not shown), if necessary, and can be manufactured in a plastic composite composition to match up with the domestic water feed line with offset structure body. The present inventor recognizes the fact that any current water valve fitting could be used to draw water from the domestic water line 18 but believes that the inventor's hollow body flow valve contained in an offset structure body is superior to any current water valve for use as a low volume type of means for water transfer and the fact that an interiorly threaded offset structure can easily be integrated into a manufacturing method for a specialized type of water line to coincide with the present invention—likewise for the threaded hollow body flow valve itself that will most likely be a plumbing approved plastic composite type. Both aforementioned components, being plastic composition, will be inexpensive to manufacture as well. The disclosed embodiments for water draw and transfer are the preferred embodiments of the present invention.

FIG. 5 is a section view and shows detail of the floor base collection and drain structure installed on a typical concrete slab floor. Note how the recessed rear drainage area 15 and its elevation drop are compensated for in a new concrete slab construction scenario by simply pre-forming a recession in the concrete slab itself—or leaving the concrete out (not pouring) entirely in the said pre-formed recession area behind the toilet (not shown). The on-site plumber can simply pour his own concrete (bagged) into the recession after the drains 14*a* and 14*b* and corresponding plumbing pipes are installed. This wet concrete method would further stabilize the floor base collection and drain structure on a concrete slab floor construction scenario as the floor structure could be manipulated by hand to a sufficient level point and the wet concrete, when set or cured, will hold the floor structure securely. FIG. 6 shows an alternative floor base collection and drain structure installed on a concrete floor whereas the rear recessed drain area 15 is accomplished in an interior manner. Exactly stating, the floor base is configured differently whereas the front section at toilet bowl 10 contains a thicker floor relating to its dimension so as to create a rear recessed drainage area 15, which contains a thinner floor as measured in its dimensional thickness. This difference in dimensional thickness between the two sections allows for a water gravity flow scenario to be accomplished in an interior manner from front section 10 to rear recessed drainage area 15, providing for a planar flat bottom unto the total floor base collection and drain structure. This type of floor structure might be desirable in certain concrete slab conditions, such as in an existing planar concrete floor slab scenario. This disclosed alternative embodiment could also be used, if desired, on a wood composite floor. This alternative floor embodiment will raise the toilet bowl and closet off of the finished floor the thickness dimension of the front section 10 unless the total alternative floor structure is recessed into the floor, which is entirely possible (not shown), if desired by the installer. The drain wastes and water draw apparatus structures and methods are congruous and identical to the previous drawing figures. The present inventor has disclosed what the inventor believes is the best and most comprehensible embodiments comprising the totality of the present invention relating to those individual stated component embodiments and the invention's delegation relating to its functionality as a novel sanitary system for the toilet area in any home, commercial and apartment type building and especially those institutional types of building uses such as hospitals, medical buildings, nursing homes and the like that employ extensive sanitation requirements by their staff, especially in the toilet area, for as to assent to and maintain a highest degree of cleanliness and sanitation as possible. A remote domestic running water source for cleaning and flushing—in addition to the structure to contain and drain that quite frankly, renders the remote water source as moot without it—at a toilet site is a completely novel and unobvious invention as the present inventor has done a thorough history search of any prior art on file and/or any apparatuses in the current marketplace. Any variation, collectively, or as to any disclosed embodiment individually, of the present invention or unto the total function disclosed as to what the invention accomplishes in this specification, should not be construed as limiting to the scope of the present invention. The accompanying independent and dependent claims following will further capture the essence of the present invention.

I claim:

1. An assembly for a toilet area, comprising:

a solid fluid and retention structure, surrounded by a circumstantial raised lip and mounted to a floor, the solid fluid collection and retention structure comprising a front section having a first level and a recessed rear drainage portion having a second level, which is lower than the first level, wherein the front section and the recessed rear drainage portion are joined by a step;

a toilet placed on the front section and fastened and connected to a main sewer pipe;

a first opening provided in the recessed rear drainage portion;

a second opening provided in the recessed rear drainage portion;

a grid provided in the first opening to provide openings for liquids to drain through;

a cap provided in the second opening to selectively block the second opening or open the second opening to allow solid matter to drain through;

a trapped drain connecting the first opening to the main sewer pipe;

an untrapped drain connecting the second opening to the main sewer pipe;

an offset valve housing provided with a flow valve and connected to a water line connecting a water valve to the toilet; and a hose slidably connected to the offset valve housing for a low volume water supply to be delivered by a user to the toilet surface for cleaning;

wherein water used for cleaning is collected by the solid collection and retention structure and drains through the grid in the first opening and wherein the solid matter drains through the second opening together with the water used for cleaning when the second opening is selectively opened by the user.

2. The assembly of claim 1 wherein a part of the circumstantial raised lip at a side of the recessed rear drainage portion, which opposes the step is higher than the remaining part of the circumstantial raised lip.

3. The assembly of claim 1 wherein the front section of the solid fluid collection and retention structure is mounted on the floor and the recessed rear drainage portion of the solid fluid collection and retention structure is mounted in a cut-out area of the floor.

4. A method for cleaning the assembly for toilet area of claim 1, comprising:

opening a flow valve to supply water through the hose to the surface of the toilet for cleaning;

cleaning the surface of the toilet to remove waste from the surface of the toilet, the cleaning therein producing used water and removed waste;

collecting the used water and the removed waste in the solid fluid collection and retention structure;

draining the used water through the grid in the first opening;

selectively opening the second opening if the removed waste comprises solid matter; and draining the solid matter through the second opening together with the used water when the second opening is selectively opened.

* * * * *